US006051180A

United States Patent [19]

Kwok

[11] Patent Number: 6,051,180

[45] **Date of Patent: *Apr. 18, 2000**

[54] EXTRUDING NOZZLE FOR PRODUCING NON-WOVENS AND METHOD THEREFOR

[75] Inventor: Kui-Chiu Kwok, Mundelein, Ill.

[73] Assignee: Illinois Tool Works Inc., Glenview, Ill.

[ * ] Notice: This patent is subject to a terminal disclaimer.

[21] Appl. No.: 09/143,932

[22] Filed: Aug. 13, 1998

[51] Int. Cl.[7] ..... D01D 5/098; D01D 5/14

[52] U.S. Cl. ..... 264/555; 264/103; 264/210.8; 264/211.14; 425/72.2; 425/192 S; 425/463

[58] Field of Search ..... 264/103, 210.8, 264/211.14, 555; 425/72.2, 192 S, 463

[56] References Cited

U.S. PATENT DOCUMENTS

| | | |
|---|---|---|
| Re. 33,158 | 2/1990 | Stouffer et al. . |
| Re. 33,159 | 2/1990 | Bauer et al. . |
| Re. 33,448 | 11/1990 | Bauer . |
| Re. 33,481 | 12/1990 | Ziecker et al. . |
| Re. 33,605 | 6/1991 | Bauer . |
| 2,031,387 | 2/1936 | Schwarz . |
| 2,212,448 | 8/1940 | Modigliani . |
| 2,297,726 | 10/1942 | Stephanoff . |
| 2,628,386 | 2/1953 | Tornberg . |
| 3,038,202 | 6/1962 | Harkenrider . |
| 3,176,345 | 4/1965 | Powell . |
| 3,178,770 | 4/1965 | Willis . |
| 3,192,562 | 7/1965 | Powell . |
| 3,192,563 | 7/1965 | Crompton . |
| 3,204,290 | 9/1965 | Crompton . |
| 3,213,170 | 10/1965 | Erdmenger et al. . |
| 3,253,301 | 5/1966 | McGlaughlin . |
| 3,334,792 | 8/1967 | De Vries et al. . |
| 3,380,128 | 4/1968 | Cremer et al. . |
| 3,488,806 | 1/1970 | De Cecco et al. . |
| 3,492,692 | 2/1970 | Soda et al. . |
| 3,501,805 | 3/1970 | Douglas, Jr. et al. . |
| 3,613,170 | 10/1971 | Soda et al. . |
| 3,650,866 | 3/1972 | Prentice . |
| 3,704,198 | 11/1972 | Prentice . |
| 3,755,527 | 8/1973 | Keller et al. . |
| 3,825,379 | 7/1974 | Lohkamp et al. . |
| 3,849,241 | 11/1974 | Butin et al. . |
| 3,861,850 | 1/1975 | Wallis . |
| 3,874,886 | 4/1975 | Levecque et al. . |
| 3,888,610 | 6/1975 | Brackman et al. . |
| 3,920,362 | 11/1975 | Bradt . |
| 3,923,444 | 12/1975 | Esper et al. . |
| 3,942,723 | 3/1976 | Langdon . |

(List continued on next page.)

FOREIGN PATENT DOCUMENTS

| | | |
|---|---|---|
| 44-16168 | 7/1969 | Japan . |
| 756907 | 9/1956 | United Kingdom . |
| 1392667 | 4/1975 | United Kingdom . |
| 93/15895 | 8/1993 | WIPO . |

OTHER PUBLICATIONS

Non–Wovens World magazine, Meltblown Technology Today, 1989, pp. 1–158.

The New Non–Wovens World, "Developments in Melt Blowing Technology", 1993, pp. 73–82.

(List continued on next page.)

*Primary Examiner*—Leo B. Tentoni

*Attorney, Agent, or Firm*—Donald J. Breh

[57] ABSTRACT

A parallel plate nozzle for extruding visco-elastic fluidic materials, useable in the manufacture of non-woven materials, and method therefor dispenses a plurality of first and second fluids from a corresponding plurality of first and second orifices to form first and second adjacent fluid flows. The first fluid flows are drawn and attenuated by not more than one corresponding second fluid flow at a second velocity greater than a first velocity of the first fluid flow to form corresponding first fluid filaments, which are preferably relatively continuous and vacillated chaotically. The first and corresponding second fluid flows are spaced as closely as possible to maximize filament drawing efficiency, and adjacent first fluid orifices are spaced sufficiently apart to prevent merging of the first fluid flows prior filament formation.

32 Claims, 2 Drawing Sheets

U.S. PATENT DOCUMENTS 3,947,537 3/1976 Buntin et al. .
3,970,417 7/1976 Page .
3,978,185 8/1976 Buntin et al. .
3,981,650 9/1976 Page .
4,007,625 2/1977 Houben et al. .
4,015,963 4/1977 Levecque et al. .
4,015,964 4/1977 Levecque et al. .
4,050,866 9/1977 Kilsdonk .
4,052,002 10/1977 Stouffer et al. .
4,052,183 10/1977 Levecque et al. .
4,100,324 7/1978 Anderson et al. .
4,145,173 3/1979 Pelzer et al. .
4,151,955 5/1979 Stouffer .
4,185,981 1/1980 Ohsato et al. .
4,189,455 2/1980 Raganato et al. .
4,277,436 7/1981 Shah et al. .
4,300,876 11/1981 Kane et al. .
4,340,563 7/1982 Appel et al. .
4,359,445 11/1982 Kane et al. .
4,380,570 4/1983 Schwarz .
4,457,685 7/1984 Huang et al. .
4,526,733 7/1985 Lau .
4,596,346 6/1986 Bauer .
4,645,444 2/1987 Lenk et al. .
4,652,225 3/1987 Dehennau et al. .
4,694,992 9/1987 Stouffer .
4,708,619 11/1987 Balk .
4,746,286 5/1988 Hobson .
4,747,986 5/1988 Chao .
4,785,996 11/1988 Ziecker et al. .
4,812,276 3/1989 Chao .
4,818,463 4/1989 Buehning .
4,818,464 4/1989 Lau .
4,826,415 5/1989 Mende .
4,874,451 10/1989 Boger et al. .
4,889,476 12/1989 Beuhning .
4,905,909 3/1990 Woods .
4,923,706 5/1990 Binley et al. .
4,949,668 8/1990 Heindel et al. .
4,955,547 9/1990 Woods .
4,983,109 1/1991 Miller et al. .
5,013,232 5/1991 Way .
5,017,116 5/1991 Carter et al. .
5,035,361 7/1991 Stouffer .
5,066,435 11/1991 Lorenz et al. .
5,067,885 11/1991 Stevenseon et al. .
5,069,853 12/1991 Miller .
5,094,792 3/1992 Baran .
5,098,636 3/1992 Balk .
5,114,752 5/1992 Hall .
5,129,585 7/1992 Bauer .
5,145,689 9/1992 Allen et al. .
5,165,940 11/1992 Windley .
5,207,970 5/1993 Joseph et al. .
5,260,003 11/1993 Nyssen et al. .
5,269,670 12/1993 Allen et al. .
5,342,647 8/1994 Heindel et al. .
5,354,378 10/1994 Hauser et al. .
5,407,619 4/1995 Maeda et al. .
5,409,733 4/1995 Boger et al. .
5,418,009 5/1995 Raterman et al. .
5,421,921 6/1995 Gill et al. .
5,421,941 6/1995 Allen et al. .
5,423,935 6/1995 Benecke et al. .
5,429,840 7/1995 Raterman et al. .
5,445,509 8/1995 Allen et al. .
5,458,291 10/1995 Brusko et al. .
5,458,721 10/1995 Raterman .
5,478,224 12/1995 McGuffy .
5,503,784 4/1996 Balk .
5,524,828 6/1996 Raterman et al. .
5,533,675 7/1996 Benecke et al. .
5,540,804 7/1996 Raterman .
5,605,706 2/1997 Allen et al. .
5,618,347 4/1997 Clare et al. .
5,618,566 4/1997 Allen et al. .
5,620,139 4/1997 Ziecker .
5,679,379 10/1997 Fabbricante et al. .
5,902,540 5/1999 Kwok .
5,904,298 5/1999 Kwok .

OTHER PUBLICATIONS

McNally et al., J & M Laboratory, "Durafiber/Durastitch Adhesives Applicaitons Methods Featuring Solid State Application Technology", Sep. 8, 1997 at Inda–Tec 97 Meeting, Cambridge, MA, pp. 26.1–26.8.

Gregory F. Ward, "Micro–Denier NonWoven Process and Fabrics", on or about Oct. 1997, pp. 1–9.

Nordson Corp., "Control Coat System", "Control Fiberization Gun", "Meltex", "EP Coating Heads", Metering Technology, Web pages, Apr. 23, 1998, 9 pgs.

EXTRUDING NOZZLE FOR PRODUCING NON-WOVENS AND METHOD THEREFOR

CROSS REFERENCE TO RELATED APPLICATIONS

The present application is related to U.S. application Ser. No. 08/717,090 filed on Oct. 10, 1996, entitled "Meltblowing Method and Apparatus", now U.S. Pat. No. 5,902,540 and to U.S. application Ser. No. 08/843,224 filed on Apr. 14, 1997, entitled "Improved Meltblowing Method and System", now U.S. Pat. No. 5,904,298 both assigned commonly and incorporated herein by reference.

BACKGROUND OF THE INVENTION

The invention relates generally to fluid dispensing nozzles, and more particularly to nozzles for extruding visco-elastic fluidic materials into filaments useable for producing non-woven materials and for depositing adhesives, and methods therefor.

Non-woven materials are known generally and used widely, for example as substrates, which are laminated in the manufacture of a variety of bodily fluid absorbing hygienic articles, and for many other applications. Non-woven materials are formed generally by extruding visco-elastic fluidic materials, like polypropolene or polyethylene or some other polymer, from nozzles into fibers or filaments, which are deposited and combined overlappingly onto an underlying screen or other substrate where the filaments are adhered together, sometimes with an adhesive as is known.

Prior art filament extruding nozzles suitable for non-woven applications generally draw a visco-elastic fluidic material in either continuous or discrete flows from an orifice with a relatively high velocity converging gas like air dispensed concentrically thereabout. U.S. Pat. No. 3,920,362 issued on Nov. 18, 1975, entitled "Filament Forming Apparatus With Sweep Fluid Channel Surrounding Spinning Needle" for example discloses a nozzle having a converging gas passage with a primary orifice and a needle protruding concentrically therein in spaced relation to interior walls of the passage. A drawing gas flowing convergently through the passage between the walls thereof and the needle sweeps liquid from a spin-off tip thereof thus drawing the liquid through the primary orifice and forming continuous or discrete filaments, depending on the liquid supply rate. A plurality of secondary discrete discharge orifices disposed about the primary orifice direct converging secondary gas flows toward the filament. The converging secondary gas flows may contain catalysts for curing or otherwise affecting the filament, and/or may be oriented to impart twist or to further stretch the filament.

The extruding nozzles of the type disclosed in U.S. Pat. No. 3,920,362 and most other extruding nozzles require precision machining operations for the manufacture thereof, and are thus relatively costly. Concentrically configured extruding nozzles of the type disclosed in U.S. Pat. No. 3,920,362 are also relatively bulky, and cannot be fabricated into high density arrays, which are increasingly desirable for many applications, particularly non-woven manufacturing operations. Concentrically configured nozzles also require relatively large amounts of gas to draw the filaments, and are thus relatively inefficient. This is true whether the drawing gas flows in a continuous sheath or in multiple discrete flows arranged concentrically about the drawn fluid. Converging the drawing air flow toward the liquid, as in U.S. Pat. No. 3,920,362, further reduces the drawing efficiency since a component of the converging air flow transverse to the liquid flow direction has no affect on drawing. Also, most sweeping or drawing gases are supplied from compressed air systems, which generally have limited supply pressure capacities, and are costly to operate and maintain. It is therefore generally desirable to reduce consumption of the drawing gas.

The present invention is drawn toward advancements in the art of nozzles for extruding visco-elastic fluidic materials, useable for producing non-woven materials and depositing adhesives, and methods therefor.

It is an object of the invention to provide novel nozzles for extruding visco-elastic fluidic materials and methods therefor that overcome problems in the art.

It is another object of the invention to provide novel nozzles for extruding visco-elastic fluidic materials, useable for producing non-woven materials and depositing adhesives, and methods therefor that are economical.

It is another object of the invention to provide novel nozzles and methods therefor for extruding visco-elastic fluidic materials relatively efficiently, and more particularly extrusion nozzles that require less drawing gas or air.

It is a further object of the invention to provide novel nozzles for extruding visco-elastic fluidic materials efficiently, useable for producing non-woven materials and depositing adhesives, and methods therefor, and more particularly extruding nozzles having relatively reduced size, and extruding nozzles that may be manufactured economically and in relatively high density arrays without merging visco-elastic flows drawn from adjacent visco-elastic orifices prior to formation of the visco-elastic filaments.

It is a more particular object of the invention to provide novel nozzles for extruding visco-elastic fluidic materials and methods therefor comprising dispensing a plurality of first and second fluids from a plurality of first and second orifices to form corresponding first and second adjacent fluid flows. The first fluid flows are drawn and attenuated by not more than one corresponding second fluid flow at a second velocity greater than a first velocity of the first fluid flow to form corresponding first fluid filaments, which are preferably relatively continuous and vacillated chaotically. The corresponding first and second fluid flows are spaced as closely as possible to maximize filament drawing efficiency, and adjacent first fluid orifices are spaced sufficiently apart to prevent merging of the first fluid flows prior filament formation.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
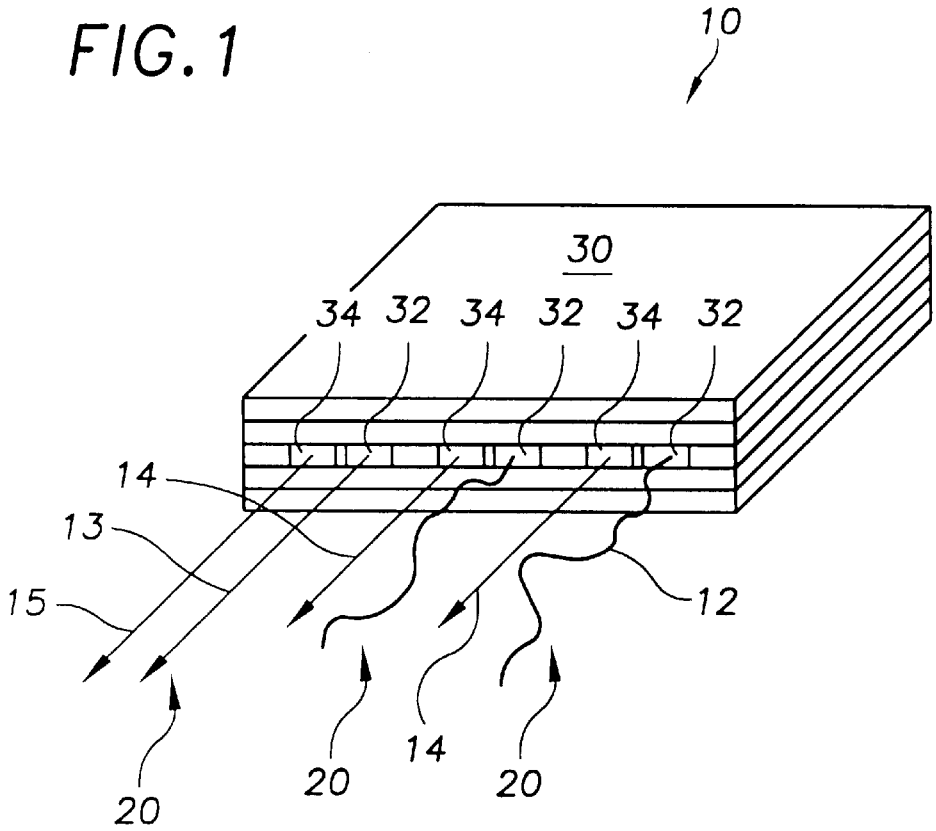
FIG. 1 is a perspective view of an extruding nozzle of the invention.

FIG. 1 is an apparatus 10 for extruding one or more filaments 20 from visco-elastic fluidic materials. In the exemplary non-woven material manufacturing application, the visco-elastic material is a polypropolene or a polyethylene or some other polymer, that may be drawn into fibers or filaments, which are preferably relatively continuous, combinable overlappingly, and adherable to form the non-woven material as is known generally. Alternatively, the visco-elastic fluidic material may be an adhesive material for deposition onto a substrate for bonding to another article.

The visco-elastic filaments 20 are formed generally by dispensing the visco-elastic fluidic material to form a first fluid flow 12 at a first velocity, and dispensing a second fluid to form a second fluid flow 14 adjacent to the first fluid flow 12, and drawing the first fluid flow 12 with not more than one adjacent second fluid flow 14 at a second velocity greater than the first velocity of the first fluid flow, whereby the drawn first fluid flow 12 is attenuated to form a first fluid filament 20.

FIG. 1 illustrates the second fluid flow 14 spaced relatively closely and adjacently to the first fluid flow 12 so that not more than one second fluid flow 14 will draw and attenuate the first fluid flow 12 to form the filament 20, thereby maximizing the fiber drawing efficiency and reducing consumption of the drawing gas, which is usually air. The second fluid flow 14 associated with the first fluid flow 12 thus draws and preferably chaotically vacillates the first fluid flow 12 and the corresponding filament 20, which is desirable for manufacturing non-woven materials and for some adhesive deposition operations. The visco-elastic fluid flow 12 may be introduced generally into the second fluid flow from most any angle without significantly reducing drawing efficiency, since the directional velocity of the second fluid flow 14 dominates and controls the ultimate direction of the visco-elastic fluid flow 12. The initial relative orientation of the first and second fluid flows however is preferably parallel, as illustrated by the schematic first and second flows 13 and 15 in FIG. 1, since the parallel orientation has advantages for the manufacture of extruding nozzles useable for producing filaments according to the present invention as discussed further below.

For many applications, including non-woven manufacturing applications and some adhesive deposition operations, the visco-elastic fluidic material is dispensed to form a plurality of first fluid flows 12 at the first velocity, and the second fluid is dispensed to form a plurality of second fluid flows 14 at the second velocity so that each of the plurality of first fluid flows 12 has associated therewith not more than one corresponding adjacent second fluid flow 14, which draws and chaotically vacillates the first fluid flow 12, whereby the drawn plurality of first fluid flows are attenuated to form a corresponding plurality of first fluid filaments 20. As discussed, each second fluid flow 14 is spaced relatively closely and adjacently to the corresponding first fluid flow 12 so that not more than one second fluid flow 14 draws and attenuates the associated first fluid flow 12, thereby maximizing the filament drawing efficiency and reducing consumption of the drawing gas.

Figure 4:
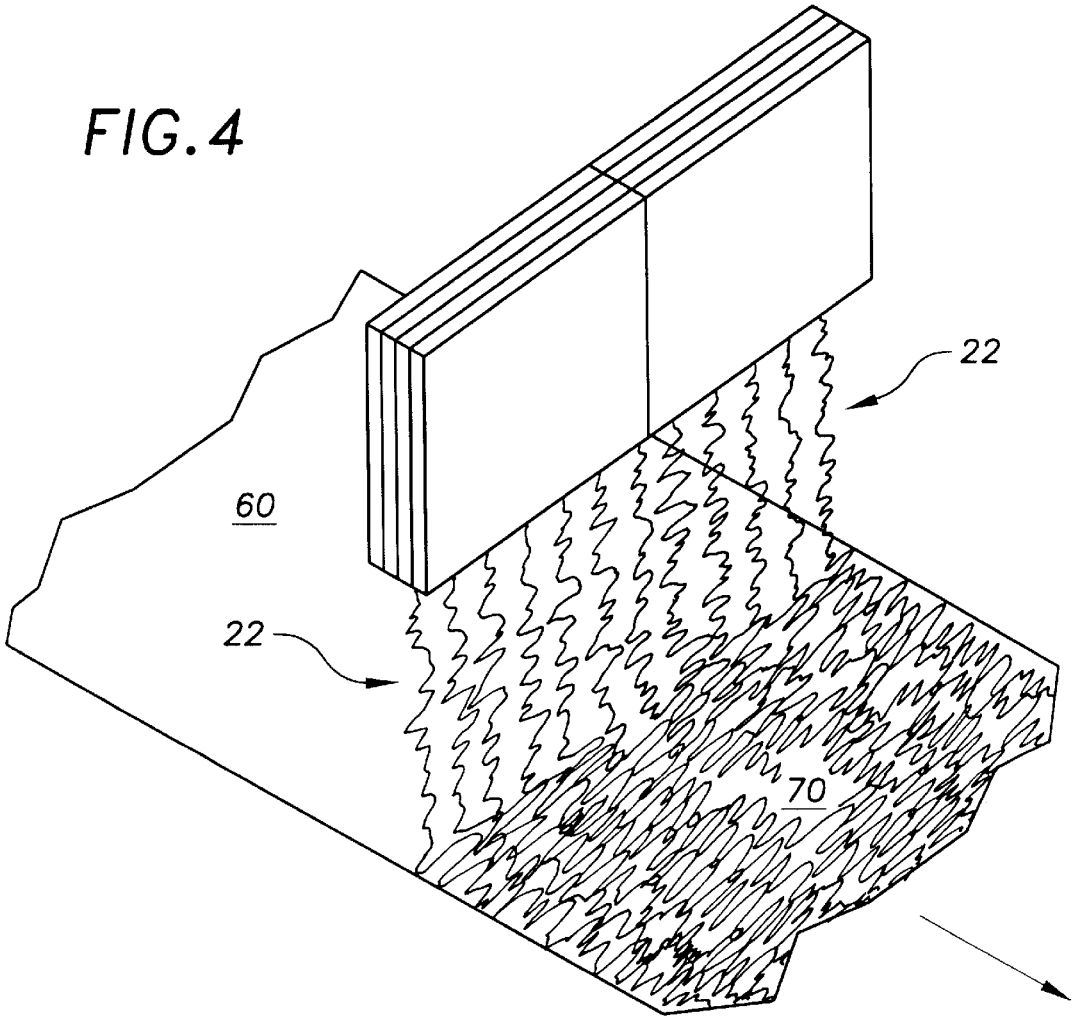
FIG. 4 is illustrates the production of a non-woven material with an extruding nozzle according to the invention.

FIG. 4 illustrates the plurality of chaotically vacillating first fluid filaments 20 arranged in an array, identified collectively by numeral 22, disposed across a substrate 60 moving relative thereto. In the exemplary non-woven material manufacturing operation, the substrate 60 is a non-adhering fiber collection bed or screen. The plurality of chaotically vacillating filaments 20 are combined and adhered together as they are drawn toward and deposited onto the substrate 60 to form a non-woven material 70. FIG. 4 may alternatively represent an array of chaotically vacillating adhesive filaments deposited onto a substrate 60 for a bonding operation.

In FIG. 1, the apparatus 10 for extruding one or more filaments 20 from visco-elastic fluidic materials comprises generally a body member 30 having one or more first orifices 32 for dispensing the visco-elastic fluidic material and forming a corresponding plurality of first fluid flows 12. Not more than one corresponding second orifice 34 in the body member 30 is associated adjacently with each first orifice 32 for dispensing a corresponding second fluid and forming not more than one second fluid flow 14 adjacent to the first fluid flow 12, whereby the first fluid flow 12 is drawable and attenuatable by not more than the corresponding second fluid flow 14 to form a corresponding first fluid filament 20, which preferably vacillates chaotically.

The filament drawing efficiency increases as the spacing between the associated first and second orifices 32 and 34 decreases, and therefore the associated first and second orifices 32 and 34 are preferably spaced as closely as possible to maximize filament drawing efficiency and to reduce drawing gas consumption. The spacing between the corresponding first and second orifices 32 and 34 is preferably not more than approximately 20 times the width of the visco-elastic fluidic material flow as it exits from the orifice prior to drawing, since the drawing efficiency decreases with increasing spacing therebetween. In one exemplary embodiment, the spacing between the corresponding first and second orifices 32 and 34 is between approximately 0.0005 inches and approximately 0.001 inches, which is presently representative of the practical limit on the proximity with which the separate first and second orifices may be spaced in extruding nozzles suitable for the exemplary applications.

In applications where the apparatus 10 comprises a plurality of first orifices 32 and a corresponding plurality of associated second orifices 34, the plurality of first orifices must be spaced sufficiently far apart to prevent merging of adjacent first fluid flows 12 before drawing and forming the plurality of fluid filaments. The minimum spacing between adjacent or neighboring first orifices 32 required to prevent merging thereof before filament formation depends on the spacing between the first orifices 32 and the corresponding second orifices 34. The required spacing between adjacent first orifices 32 decreases as the spacing between the first orifice 32 and the corresponding second orifice 34 decreases. More particularly, the greater the first fluid flow 12 is drawn, or influenced, by the corresponding second fluid flow 14 resulting from the close proximity thereof, the less is the tendency of the first fluid flow 12 to be affected by an adjacent first fluid flow, and therefore the more closely the adjacent first fluid flows may be spaced from other first fluid flows without merging.

Figure 2:
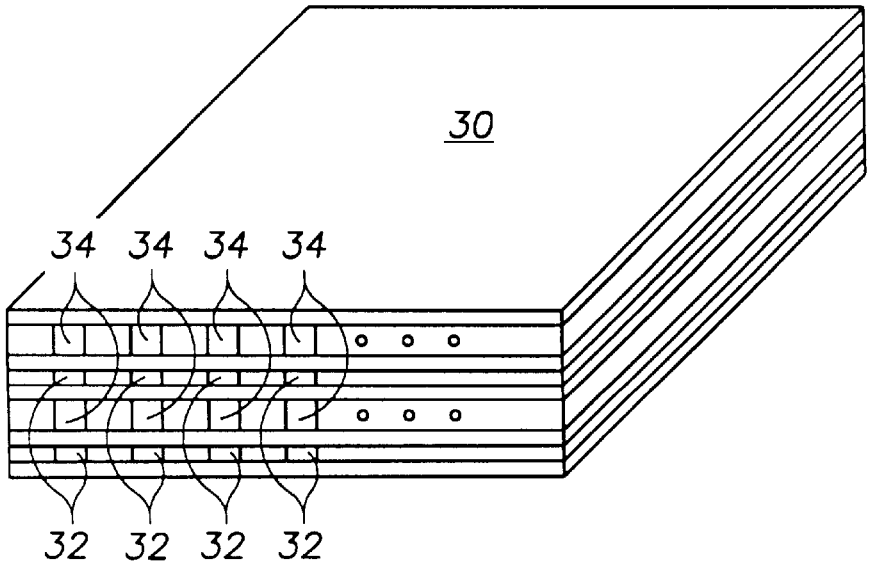
FIG. 2 is a perspective view of an alternative extruding nozzle.

FIG. 2 illustrates an exemplary embodiment of the body member 30 comprising at least some of the plurality of first orifices 32 arranged in a first row or series of first orifices, and at least some of the plurality of second orifices 34 arranged in a first row or series of second orifices parallel to the first series of first orifices 32 so that each of the plurality of first orifices 32 is adjacent a corresponding one of the plurality of second orifices 34.

Figure 3:
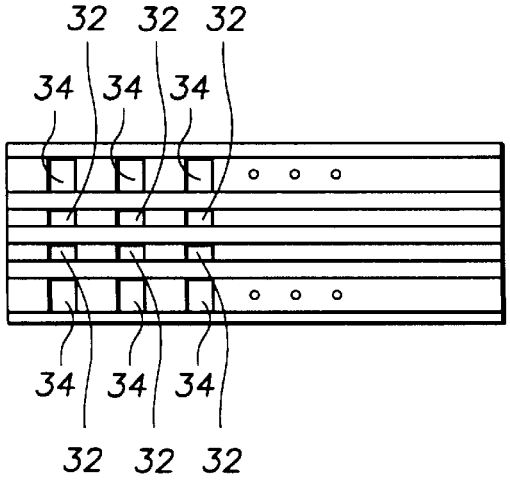
FIG. 3 is an end view of another alternative extruding nozzle.

The body member 30 may include multiple rows of first and corresponding second orifices 32 and 34 to increase the density of the filaments produced. In one embodiment, at least some of the plurality of first orifices 32 are arranged in a second series of first orifices, and at least some of the plurality of second orifices 34 arranged in a second series of second orifices 34 parallel to the second series of first orifices so that each of the plurality of first orifices is adjacent a corresponding one of the plurality of second orifices. The first and second series of first orifices are preferably arranged in parallel, and may be aligned in columns or offset relative to those in an adjacent row or series. In FIG. 2, the first and second series of first orifices 32 are separated by one of the corresponding first or second series of second orifices 34. In FIG. 3, the first and second series of first orifices are separated by the first and second series of second orifices disposed between and in parallel with the first and second series of first orifices. Additional series or rows of corresponding first and second orifices 32 and 34 may also be added.

In one preferred embodiment illustrated in FIGS. 1, 2 and 3, the body member 30 comprises a plurality of parallel plate members, which may be fabricated as disclosed more fully in the referenced copending U.S. applications entitled "Meltblowing Method and Apparatus" and "Improved Meltblowing Method and System". Forming the body member 30 from parallel plate members is highly cost effective in comparison to other conventional nozzles. According to this construction, as illustrated in FIGS. 2 and 3, the first and second orifices 32 and 34 are preferably separated by an intervening parallel plate of the body member, which permits relatively reduced spacing therebetween in comparison to the minimum spacing possible by forming the first and second orifices 32 and 34 side-by-side in the same plate, as illustrated in FIG. 1, or by formation in other more conventional nozzles.

In one exemplary embodiment suitable for manufacturing non-woven materials and some adhesive deposition operations, the apparatus 10 is a parallel plate body member having a plurality of first and corresponding second orifices 32 and 34 arranged preferably in multiple series, as discussed above. The visco-elastic dispensing first orifices 32 are generally smaller than the corresponding air dispensing second orifices 34, and in one embodiment the area of the first orifice 32 is approximately one-half the area of the corresponding second orifice 34. In one embodiment, for example, the visco-elastic fluidic material dispensing first orifice is approximately 0.008 inches by approximately 0.008 inches, and the corresponding air dispensing second orifice is approximately 0.24 inches by approximately 0.18 inches. The spacing between corresponding first and second orifices is between approximately 0.0005 inch and approximately 0.001 inch, wherein the spacing is preferably formed by an intervening plate having a thickness corresponding to said spacing. In one exemplary configuration for producing non-woven materials, the visco-elastic material flow rate is approximately 12 gram per square meter, and the air pressure is between approximately 50 pounds per square inch (psi) and approximately 70 psi. These dimensions and operating parameters, however, are exemplary only and are not intended to be limiting.

The first and second orifices are preferably arranged in the body member 30 to form corresponding parallel first and second fluid flows 12 and 14. Such an arrangement provides for relatively dense arrays of first and second orifices, since the corresponding parallel fluid supply passages formed in the plates may be arranged more densely. More generally, however, the corresponding first and second fluid flows 12 and 14 may converge without substantially adversely affecting the drawing efficiency since the visco-elastic fluid flow is readily dominated and directed by the second fluid, or drawing air, flow, which ultimately controls the direction of the corresponding filament.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A method for extruding a filament from a visco-elastic fluidic material, useable in the manufacture of non-woven materials, comprising:

dispensing the visco-elastic fluidic material to form a first fluid flow at a first velocity;

dispensing a second fluid to form a second fluid flow at a second velocity greater than the first velocity of the first fluid flow, the second fluid flow adjacent to the first fluid flow;

drawing the first fluid flow with not more than one second fluid flow adjacent to the first fluid flow, whereby the drawn first fluid flow is attenuated to form a first fluid filament.

2. The method of claim 1 further comprising chaotically vacillating the first fluid flow with not more than one adjacent second fluid flow.

3. The method of claim 1 further comprising dispensing the first fluid from a first orifice in a body member, and dispensing the second fluid from a separate second orifice in the body member associated adjacently with the first orifice, the second orifice spaced apart from the first orifice not more than approximately 20 times a width of the first fluid flow.

4. The method of claim 1 further comprising dispensing the first fluid from a first orifice in a body member, and dispensing the second fluid from a separate second orifice in the body member associated adjacently with the first orifice, the second orifice spaced apart from the first orifice between approximately 0.0005 inches and approximately 0.001 inches.

5. The method of claim 1 further comprising:

dispensing the visco-elastic fluidic material from a plurality of first orifices to form a plurality of first fluid flows at the first velocity;

dispensing the second fluid from a plurality of second orifices to form a plurality of second fluid flows at the second velocity, each of the plurality of second orifices associated adjacently with a corresponding one of the plurality of first orifices so that each of the plurality of first fluid flows has not more than one corresponding adjacent second fluid flow;

drawing each of the plurality of first fluid flows with not more than the corresponding adjacent second fluid flow, whereby the drawn plurality of first fluid flows are attenuated to form a plurality of first fluid filaments.

6. The method of claim 5 further comprising chaotically vacillating the plurality of first fluid flows with the corresponding plurality of second fluid flows.

7. The method of claim 6 further comprising depositing the plurality of first fluid filaments onto a substrate and combining the plurality of first fluid filaments to form a non-woven material.

8. The method of claim 5 further comprising dispensing the visco-elastic fluidic material from the plurality of first orifices spaced sufficiently apart to prevent merging of adjacent first fluid flows before forming the plurality of first fluid filaments.

9. The method of claim 8 further comprising:

dispensing at least some of the visco-elastic fluidic material from a first series of first orifices to form the plurality of first fluid flows;

dispensing at least some of the second fluid from a first series of second orifices to form the plurality of second fluid flows, the first series of first orifices arranged parallel to the first series of second orifices so that each of the plurality of first orifices is adjacent a corresponding one of the second orifices.

10. The method of claim 9 further comprising dispensing at least some of the visco-elastic fluidic material from a second series of first orifices, and dispensing at least some of the second fluid from a second series of second orifices arranged parallel to the second series of first orifices so that each of the first orifices is adjacent a corresponding one of the second orifices.

11. An apparatus for extruding a filament from a visco-elastic fluidic material, useable in the manufacture of non-woven materials, comprising:

a first orifice in a body member for dispensing a visco-elastic fluidic material and forming a first fluid flow at a first velocity;

a second orifice in the body member adjacent to the first orifice for dispensing a second fluid and forming a second fluid flow adjacent to the first fluid flow, the second fluid flow at a second velocity greater than the first velocity of the first fluid flow, the first orifice and the adjacent second orifice spaced apart so that the first fluid flow is drawable and attenuatable by not more than the second fluid flow to form a first fluid filament.

12. The apparatus of claim 11 further comprising the first orifice spaced apart from the second orifice not more than approximately 20 times a width of the first fluid flow dispensable from the first orifice.

13. The apparatus of claim 11 further comprising:

a plurality of first orifices in the body member for dispensing the visco-elastic fluidic material and forming a plurality of first fluid flows;

a plurality of second orifices in the body member for dispensing the second fluid and forming a plurality of second fluid flows, each of the plurality of second orifices associated adjacently with a corresponding one of the plurality of first orifices so that each of the plurality of first fluid flows has not more than one corresponding adjacent second fluid flow;

each of the plurality of first orifices spaced apart from the corresponding adjacent second orifice so that the first fluid flow is drawable and attenuatable by not more than the adjacent second fluid flow to form a corresponding first fluid filament.

14. The apparatus of claim 13 further comprising each of the plurality of first orifices spaced apart from the corresponding adjacent second orifice not more than approximately 20 times a width of the first fluid flow dispensable from the first orifice.

15. The apparatus of claim 13 further comprising each of the plurality of first orifices spaced apart from the corresponding adjacent second orifice from between approximately 0.0005 inches and approximately 0.001 inches.

16. The apparatus of claim 13 further comprising the plurality of first orifices spaced sufficiently apart to prevent merging of adjacent first fluid flows before forming the plurality of first fluid filaments.

17. The apparatus of claim 13 further comprising at least some of the plurality of first orifices arranged in a first series of first orifices, and at least some of the plurality of second orifices arranged in a first series of second orifices parallel to the first series of first orifices so that each of the plurality of first orifices is adjacent a corresponding one of the plurality of second orifices.

18. The apparatus of claim 17 further comprising at least some of the plurality of first orifices arranged in a second series of first orifices, and at least some of the plurality of second orifices arranged in a second series of second orifices parallel to the second series of first orifices so that each of the plurality of first orifices is adjacent a corresponding one of the plurality of second orifices.

19. The apparatus of claim 11 further comprising the body member is a plurality of parallel plate members.

20. The apparatus of claim 19 further comprising the first orifice separated from the second orifice by a parallel plate of the body member.

21. A viscoelastic fluidic material method comprising:

forming a first fluid flow by dispensing a first viscoelastic fluidic material from a first orifice in a body member;

forming a second fluid flow by dispensing a second fluid from a second orifice in the body member;

drawing the first fluid flow with not more than the second fluid flow adjacent the first fluid flow, whereby the first fluid flow is attenuated to form a first fluid filament.

22. The method of claim 21, chaotically vacillating the first fluid filament with the second fluid flow.

23. The method of claim 21, forming a plurality of first fluid flows by dispensing the first viscoelastic fluidic material from a plurality of first orifices in the body member;

forming a plurality of second fluid flows by dispensing the second fluid from a plurality of second orifices in the body member;

drawing each of the plurality of first fluid flows with not more than one corresponding adjacent second fluid flow, whereby the plurality of first fluid flows are attenuated to form a plurality of first fluid filaments.

24. The method of claim 23, chaotically vacillating the plurality of first fluid filaments with a corresponding one of the second fluid flows.

25. The method of claim 24, depositing the plurality of chaotically vacillating first fluid filaments onto a substrate.

26. The method of claim 24, combining the plurality of filaments to form a non-woven material.

27. A viscoelastic fluidic material apparatus comprising:

a first orifice in a body member;

a second orifice in the body member adjacent to the first orifice;

the first orifice and the adjacent second orifice spaced apart so that a first fluid flow dispensed from the first orifice is drawable and attenuatable to form a filament by not more than a single second fluid flow dispensed from the adjacent second orifice.

28. The apparatus of claim 27, the first orifice spaced apart from the second orifice not more than approximately 20 times a width of the first fluid flow dispensed from the first orifice.

29. The apparatus of claim 27 in combination with a vacillating filament emanating from the first orifice and a fluid flow emanating from the second orifice.

30. The apparatus of claim 27, a plurality of first orifices in the body member, and a plurality of second orifices in the body member, each of the plurality of first orifices having associated therewith not more than one of the plurality of second orifices, the first orifice and the associated second orifice adjacent each other and spaced apart so that a first fluid flow dispensed from the first orifice is drawable and attenuatable to form a filament by not more than a single second fluid flow dispensed from the adjacent second orifice.

31. The apparatus of claim 30 in combination with a plurality of chaotically vacillating filaments each emanating from a corresponding one of the plurality of first orifices, and a plurality of fluid flows each emanating from a corresponding one of the plurality of second orifices.

32. The apparatus of claim 31, the body member comprises a plurality of plates.

* * * * *